US007483649B2

(12) United States Patent
Nakahata

(10) Patent No.: US 7,483,649 B2
(45) Date of Patent: Jan. 27, 2009

(54) IMAGE FORMING APPARATUS INCLUDING A PLURALITY OF IMAGE FORMING UNITS DISPOSED SO AS TO BE REMOVABLE WITHOUT DAMAGING AN INTERMEDIATE TRANSFERRING MEMBER

(75) Inventor: Hiroshi Nakahata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 11/875,232

(22) Filed: Oct. 19, 2007

(65) Prior Publication Data

US 2008/0044201 A1 Feb. 21, 2008

Related U.S. Application Data

(62) Division of application No. 11/270,592, filed on Nov. 10, 2005, now Pat. No. 7,302,206.

(30) Foreign Application Priority Data

Nov. 12, 2004 (JP) ..... 2004-329237

(51) Int. Cl.
*G03G 21/16* (2006.01)

(52) U.S. Cl. ..... 399/111

(58) Field of Classification Search ..... 399/110, 399/111, 116, 117, 121, 124, 125
See application file for complete search history.

(56) References Cited

U.S. PATENT DOCUMENTS 5,950,052 A 9/1999 Nomura et al.
6,832,061 B2 12/2004 Saito et al.
7,072,601 B2 * 7/2006 Kakitani et al. ..... 399/111
2006/0067733 A1 3/2006 Kawasumi
2006/0099008 A1 5/2006 Kurita
2006/0104662 A1 5/2006 Kawasumi
2006/0104663 A1 5/2006 Kitozaki

FOREIGN PATENT DOCUMENTS

JP 10-115961 5/1998
JP 2003-208073 7/2003
JP 2004-85899 3/2004

* cited by examiner

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

The image forming apparatus has an image forming device including a plurality of image forming units each having an image bearing member and attachable to and detachable from the image forming apparatus, and an intermediate transferring member disposed above the plurality of image forming units and bearing toner images transferred from the image bearing members of the image forming units, an opening portion, formed by rotating the intermediate transferring member upward, for attaching and detaching the image forming units, and a guide portion for guiding each of the image forming units to be attached and detached from the opening portion, wherein the guide portion for at least the image forming unit installed on the side of a rotating portion of the intermediate transferring member, is inclined in a direction opposite to the rotating portion. With this configuration, it is possible to prevent influence of an open/close cover when attaching and detaching a process cartridge.

5 Claims, 7 Drawing Sheets

IMAGE FORMING APPARATUS INCLUDING A PLURALITY OF IMAGE FORMING UNITS DISPOSED SO AS TO BE REMOVABLE WITHOUT DAMAGING AN INTERMEDIATE TRANSFERRING MEMBER

CROSS-REFERENCE TO RELATED APPLICATION

This application is a divisional application of application Ser. No. 11/270,592, filed Nov. 10, 2005.

BACKGROUND OF THE INVENTION

1. Field of the Invention

The present invention relates to an image forming apparatus such a copying-machine and a printer that adopts an electrophotographic system, and more particularly to operability when exchanging consumable supplies in the image forming apparatus including a plurality of image bearing members.

2. Description of Related Art

Utilized over the recent years as a multi-color or full-color image forming apparatus of the electrophotographic system is an in-line type image forming apparatus, wherein a plurality of photosensitive drums are arranged in one line corresponding to respective colors, and color toner images formed on the respective photosensitive drums are sequentially superposed on an intermediate transferring belt, thus forming color images. FIG. 5 shows a conventional in-line type image forming apparatus including the intermediate transferring member in the electrophotographic system. Photosensitive drums 20Y, 20M, 20C, 20Bk, which are constructed by applying photosensitive layers over conductive bodies, are formed with electrostatic latent images by laser beams emitted from a scanning type optical device and constantly rotate at a predetermined speed. The numeral 21 represents the scanning type optical device for irradiating the laser beams on the basis of image information transmitted from an unillustrated image reader or a personal computer etc. This scanning type optical device employs a system in which one single polygon motor unit irradiates four pieces of photosensitive drums with the laser beams, and opposite surfaces of a polygon mirror are each formed with two scanning groups for irradiating plural lines of laser beams.

Further, a plurality of return mirrors are used for attaining a compact configuration of the unit. The symbols 22Y, 22M, 22C, 22Bk designate developing devices for forming toner images on the photosensitive drums by toners that are tribo-charged on the photosensitive drums, the numeral 23 denotes an intermediate transferring belt which carries the toner images on the photosensitive drums onto a sheet for transferring, the numeral 24 represents a sheet feed cassette storing the sheets on which the toner images are formed, the numeral 25 represents a fixing device to have the transferred toner image absorbed on the sheet thermally, and the numeral 26 designates a sheet discharge tray on which the image-fixed transfer sheets are stacked. The image formation is done such that the photosensitive drums are irradiated with the laser beams from the scanning type optical device 21 on the basis of the image information, and electrostatic latent images are formed on the charged photosensitive drums 20 by cleaners 27Y, 27M, 27C, 27Bk. Thereafter, the tribo-charged toners in the developing device are adhered onto the electrostatic latent images, thereby forming the toner images on the photosensitive drums. The toner images are transferred onto the intermediate transferring belt from on the photosensitive drums and again transferred onto the sheet conveyed from the sheet feed cassette 24 provided at a lower portion of the body, thereby forming the images on the sheet. The images transferred onto the sheet are fixed with the toners by the fixing device 25, and the image-formed sheet is stacked on the sheet discharge tray. FIG. 6 shows a schematic view for explaining an opening portion of the image forming apparatus. This image forming apparatus is provided with a front door 28 that opens and closes a recording material conveyance path and with a side door 29 through which consumable supplies are exchanged. The image forming apparatus is further provided with an opening portion 31 through which the intermediate transferring belt 30 is detachably attached and with opening portions 32, 33 through which the process cartridges and toner cartridges are detachably attached. Moreover, as follows, it is disclosed, the image forming apparatus in which exposing and developing are conducted by one image bearing member.

In the image forming apparatus, each of units provided to the rotational developing device is detachably attachable from an open/close portion provided in an upper surface of the apparatus.

The respective consumable supplies and the intermediate transferring belt have hitherto been, as shown in the conventional example, attached and detached via the side door, and therefore, on the occasion of installing the image forming apparatus body, it is required that a space for opening and closing the side door be ensured in a side surface portion. Further, in the case of placing the image forming apparatus on a desktop, it follows that a user stands on the front side (On the side of an opening/closing direction of a front door 28 with a fixing portion), and is required to perform an operation by stretching the hand toward the side surface portion in order to attach and detach the process cartridges to be exchanged from the image forming apparatus. Moreover, in the in-line type image forming apparatus described above, the process cartridge on the backside is disposed at a relatively far distance from the front surface portion, so that there declines operability for performing the attaching/detaching operation by stretching the hand from the lateral direction, and a space utilized for the user to go around sideways for conducting the operation is needed for avoiding this. Hence, there arises a problem of causing the decline of the operability in such a configuration.

It is therefore desirable to have a configuration enabling the process cartridges to be attached and detached in a state where the user stands on the front side of the image forming apparatus. In this respect, Japanese Patent Application Laid-Open Publication No. 2004-85899 discloses an image forming apparatus as shown in FIG. 7. In this art as the image forming apparatus, a lower surface exposure system in which the process cartridges are positioned under an intermediate transferring member and optical units are positioned further downwardly of the process cartridges. The process cartridges are taken out in the following procedure. Namely, the procedure is that the intermediate transferring member and a stack portion stacked with the outputted recording materials are integrally released in a perpendicular direction, and thereafter the process cartridges are taken out.

Depending on the attaching/detaching direction of the process cartridge as in Japanese Patent Application Laid-Open Publication No. 2003-208073 and Japanese Patent Application Laid-Open Publication No. 10-115961, however, the process cartridge interferes with the intermediate transferring member in an open/close cover. Consequently, problems occur, wherein the attaching/detaching operability declines, and the intermediate transferring member might be damaged.

SUMMARY OF THE INVENTION

An object of the present invention is to prevent damage to an intermediate transferring member due to taking out an image forming unit close to a rotational portion of the intermediate transferring member.

Another object of the present invention is to provide an image forming apparatus including image forming means including a plurality of image forming units, each having an image bearing member and attachable to or detachable from said image forming apparatus, and an intermediate transferring-member disposed above the plurality of image forming units and bearing toner images transferred from the image bearing members of the image forming units, an opening portion supporting said intermediate transferring member and pivoting upward, for attaching and detaching said plurality of image forming units, and at least one guide portion for guiding each of said plurality of image forming units to be attached and detached from said opening portion, wherein an upper portion of a guide portion of an image forming unit positioned at a pivot center of said guide opening portion among said plurality of image forming units is inclined in a direction opposite to the direction of the pivot center side.

Further objects of the present invention will become apparent from the following discussion.

DETAILED DESCRIPTION OF THE PREFERRED EMBODIMENTS

Figure 1:
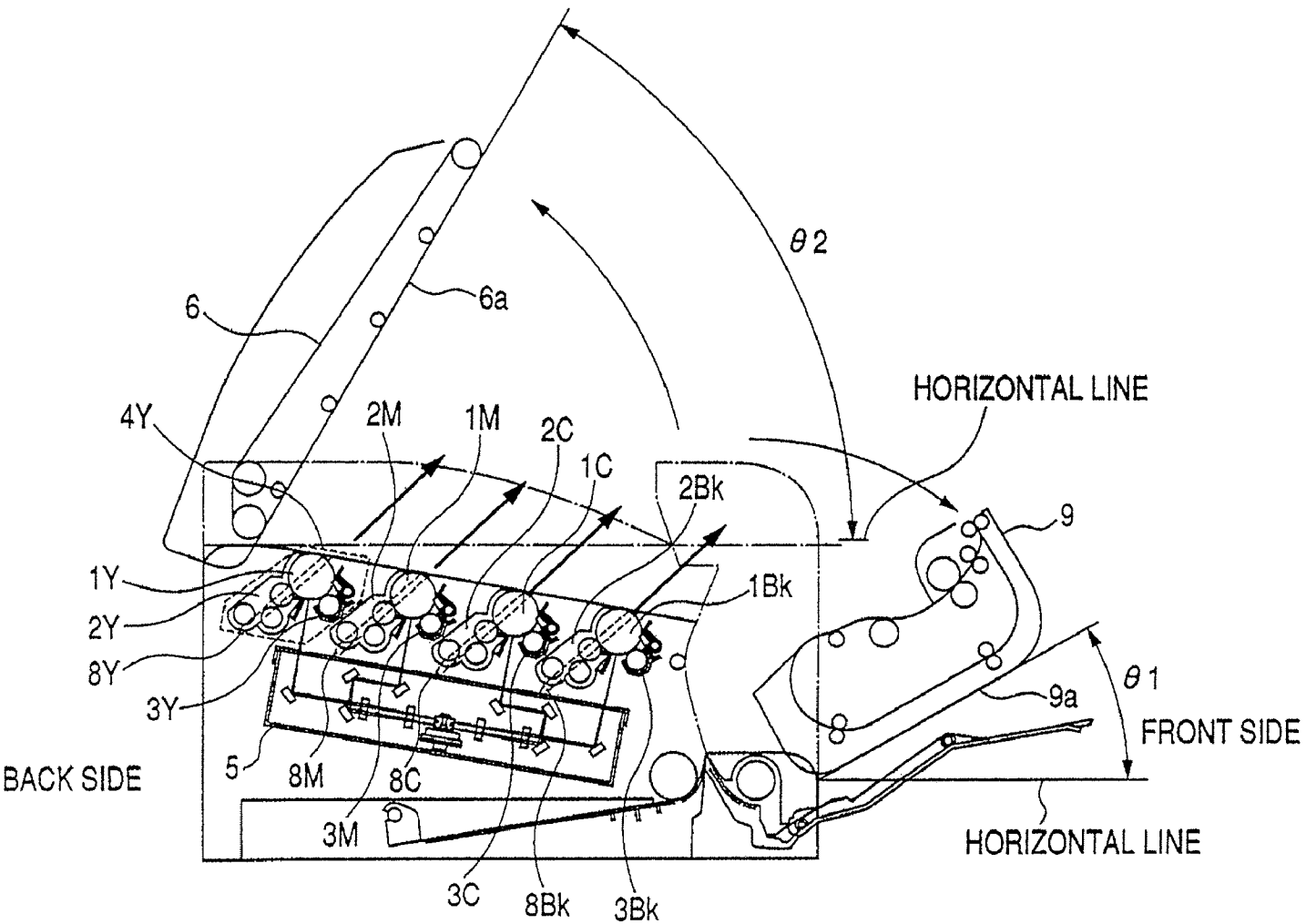
FIG. 1 is an explanatory view of an image forming apparatus in a first embodiment of the present invention.

FIG. 1 shows an image forming apparatus in a first embodiment of the present invention. The image forming apparatus illustrated in the present embodiment is an image forming apparatus called an in-line type, wherein a plurality of image forming units (process cartridges) 4Y, 4M, 4C, 4Bk (only 4Y is illustrated) including image bearing members 1Y, 1M, 1C, 1Bk, developing means 2Y, 2M, 2C, 2Bk and cleaners 3Y, 3M, 3C, 3Bk are disposed in a side-by-side relationship. The image forming apparatus according to the present invention is, as shown in FIG. 1, constructed in such a way that a side of providing a second open/close member having a recording material conveying path is set as a front side, an opposite side thereto is set as a back side, and a side surface portion is provided in a direction perpendicular to the surface of the recording material. Therefore, a user stands on the front side in FIG. 1. Hence, a front door 9 including the recording material conveying path is provided in an openable-and-closable manner to enable the processing to be done from the front side in the case of performing maintenance such as trouble-shooting a paper jam and attaching/detaching the process cartridge as will be described later on, and an external cover surface 9*a* serving as the second open/close member including the recording material conveying path can be held so as to open at an angle ?1 with respect to the horizon. Further, generally, the image forming apparatus is placed on an unillustrated desktop or by disposing an extension sheet feed cassette etc. at a lower portion of the image forming apparatus body, whereby the image forming portion bodies are set as high as a position between the abdomen and the chest of the user. Such being the case, the image bearing members are disposed side by side in an oblique direction in order to attain a more compact configuration of the apparatus while shrinking the apparatus body in a heightwise direction. Moreover, also in a scanning type optical device 5, as described in the example of the prior art, for attaining the more compact configuration of the unit, a deflection scan is conducted by one single polygon motor unit, and respective fluxes of light are image-formed on the individual image bearing members 1Y, 1M, 1C, 1Bk through fθ-lenses while forming optical paths within the unit by employing a plurality of return mirrors. An intermediate transferring belt 6 is disposed above the process cartridges, toner images exposed and developed by the respective process cartridges are sequentially transferred by primary transfer portions abutting on the image bearing members 1Y, 1M, 1C, 1Bk, and the toner images are transferred batchwise on a transfer sheet conveyed along the recording material conveying path from the lower portion at secondary transfer portions on which the recording material conveying path and the intermediate transferring belt 6 defined as an intermediate transfer member abut. The intermediate transferring belt 6 is, as shown in FIG. 1, supported on an upper door serving also as a sheet discharge tray defined as a recording material stacking portion, and is also supported in the openable-and-closable manner in a way that sets the backside of the image forming apparatus as the center of rotation, whereby the respective process cartridges 4Y, 4M, 4C, 4Bk can be detachably attached from an upper surface portion with the upper door opened. In the present embodiment, the upper door defined as a first open/close member that opens and closes together with the intermediate transfer member exists upward in the perpendicular direction. Herein, the center of rotation (pivot center) of the upper door including the intermediate transferring belt 6 is provided so that the front side opens with the back side centered so as to facilitate the user's operations of attaching and detaching the process cartridges from the front side. The upper door including the intermediate transferring belt 6 can be held in a state of opening at an angle θ2 between the horizontal direction and a direction of an externally appearing surface of a primary transfer surface 6*a*.

Figure 2:
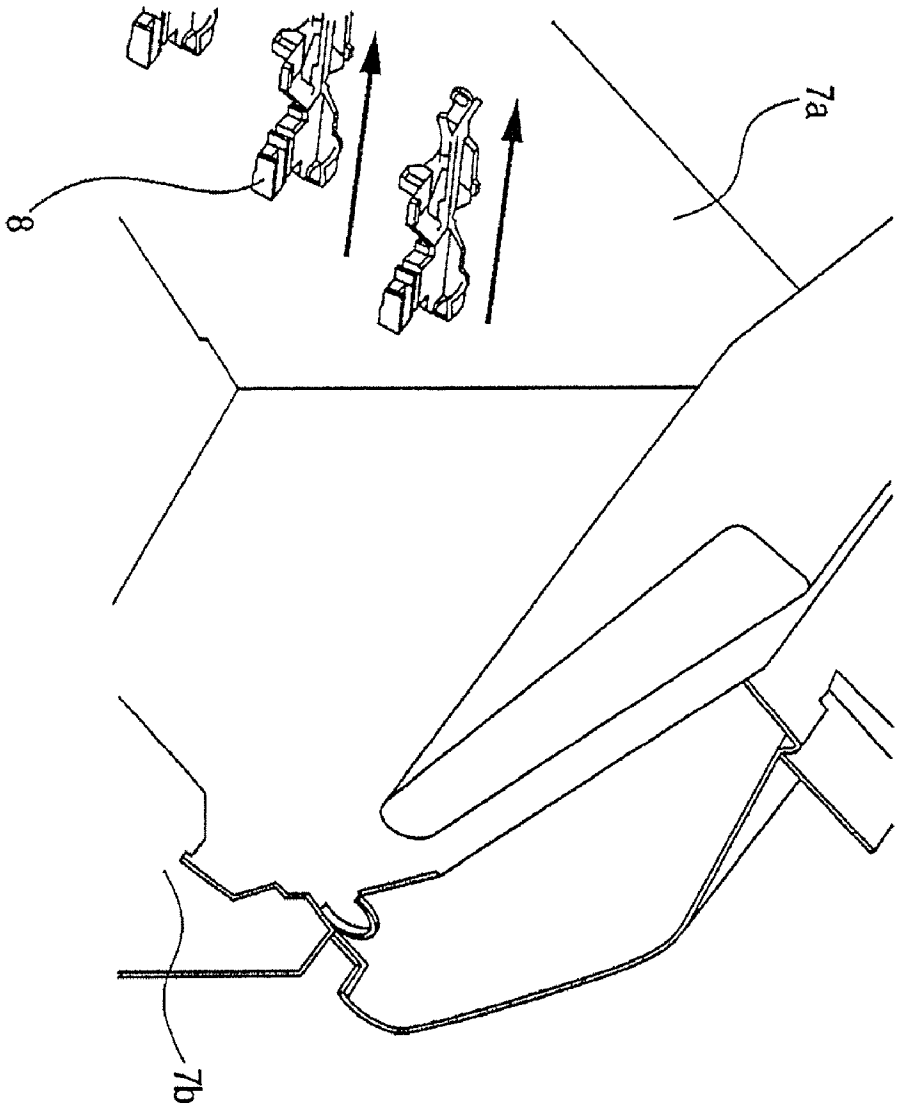
FIG. 2 is an explanatory view of cartridge rails in the first embodiment of the present invention.

Next, details of how the process cartridges are attached and detached will be described. In the in-line type image forming apparatus, the plurality of image bearing members are disposed, and hence, in the case of attaching and detaching the process cartridges from the front side, it is difficult to reach the cartridges by hand from the back side. Further, in the case of attaching and detaching the process cartridges closer to the center of the rotation of the intermediate transferring belt, i.e., the process cartridges 4Y and 4C in the perpendicular direction, the user is required to greatly stretch his hand and has a high possibility of touching the transfer surface of the intermediate transferring belt 6 when attaching and detaching the cartridges. Moreover, in the case of providing the center of rotation of the intermediate transferring belt 6 further on the backside in order to avoid hand contact, there occurs a demerit of upsizing the apparatus. This being the case, in the present embodiment, the process cartridges are attached and detached in oblique forward directions indicated by bold arrow lines in the image forming portions in FIG. 1. Cartridge rails 8Y, 8M, 8C, 8Bk, which are depicted by elongate rectangular broken lines in FIG. 1, are provided for attaching and detaching the respective process cartridges 4Y, 4M, 4C, 4Bk in the image forming apparatus, and serve as guide portions that define attaching/detaching paths of the process cartridges. Next, the cartridge rails will be explained. FIG. 2 is a perspective view of the image forming apparatus in the present embodiment as viewed from the oblique front side, Wherein components unnecessary for explaining how the cartridges are attached and detached are not illustrated. On side plates 7*a*, 7*b*of the image forming apparatus, the cartridge rails 8 as shown in FIG. 2 are provided at insert portions of the respective process cartridges, and the process cartridges are inserted up to predetermined positions along the cartridge rails in directions indicated by the arrow lines in FIG. 2. As obvious from FIG. 2, the image forming portions provided on the back side of the image forming apparatus are in close proximity to the intermediate transferring belt 6 and therefore, unless attached and detached in the oblique directions as shown in FIG. 2, get easy to touch the intermediate transferring belt 6, with the result that a special attention is needed when attached and detached. Further, it follows that the image forming portions come into contact with the front door 9 even when the attaching/detaching angle becomes approximate to the horizon.

Such being the case, according to the present invention, the configuration is that the angle of the attaching/detaching direction of the process cartridge is set larger than the angle ?1 in the state where the front door 9 opens, and is also set smaller than an angle (made between the primary transfer surface 6*a* and the horizon) ?2 in the state where the intermediate transferring belt opens, whereby the cartridge can be detachably attached without touching the intermediate transferring belt. Moreover, the process cartridge is constructed to be detachably attached in the direction oblique to the front surface of the image forming apparatus, and it is therefore possible to easily attach and detach the process cartridges disposed at the back side in the state where the user stands at the front side of the image forming apparatus.

Herein, even when the process cartridge described so far is of a type including a toner cartridge, it is apparent that the same effect can be acquired.

Further, all the cartridge rails are not necessarily set at the same angle, and a configuration that the cartridges are directly inserted in the side plate of the image forming apparatus without using the cartridge rails, may also be available.

Figure 3:
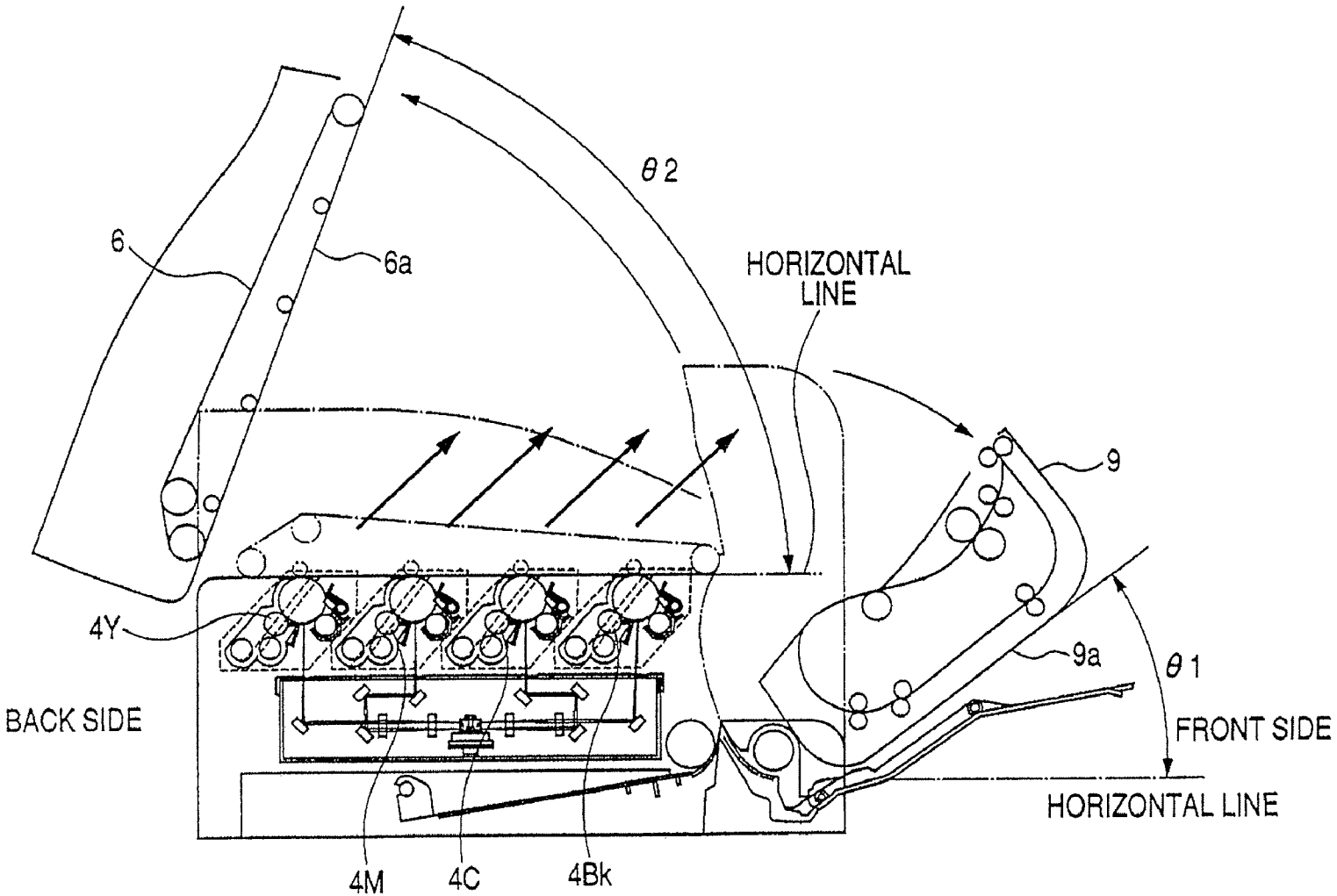
FIG. 3 is an explanatory view of an image forming apparatus body in which image forming portions are disposed horizontally.

Moreover, the image forming apparatus in which the image forming portions shown in FIG. 3 are horizontally disposed will be explained. As shown in FIG. 3, the same effect occurs in a case wherein the process cartridges 4Y, 4M, 4C, 4Bk as the image forming portions are disposed in the horizontal direction.

According to the present invention, the process cartridge can be easily attached and detached from the state where the user stands at the front surface portion of the image forming apparatus, and the user can conduct the operations of attaching and detaching the process cartridges without touching the intermediate transferring belt with the user's hand. Moreover, any operations are not performed from the side surface portion of the image forming apparatus, and hence there is no necessity of preparing a space in the side surface portion of the image forming apparatus, whereby a space efficiency can be improved.

Second Embodiment

Figure 4:
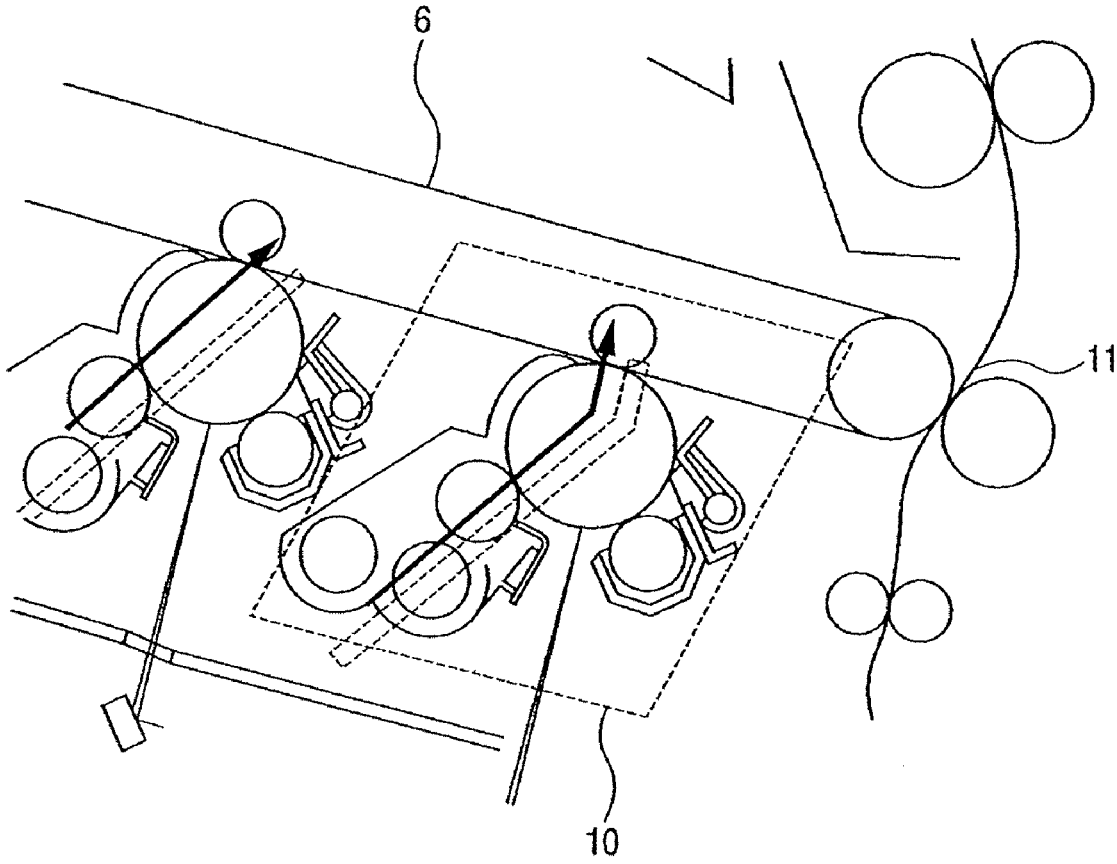
FIG. 4 is an explanatory view of the image forming apparatus in a second embodiment of the present invention.
Figure 5:
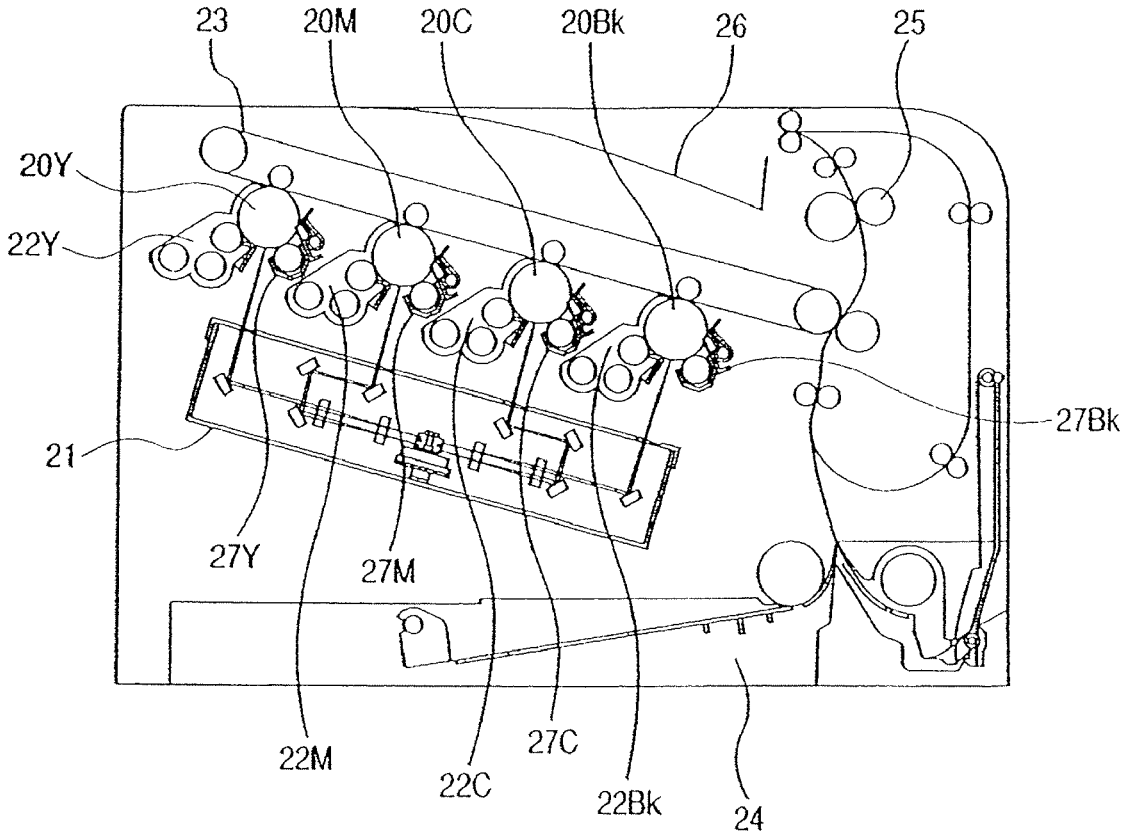
PRIOR ART FIG. 5
FIG. 5 is an explanatory view of an image forming apparatus in a conventional example.
Figure 6:
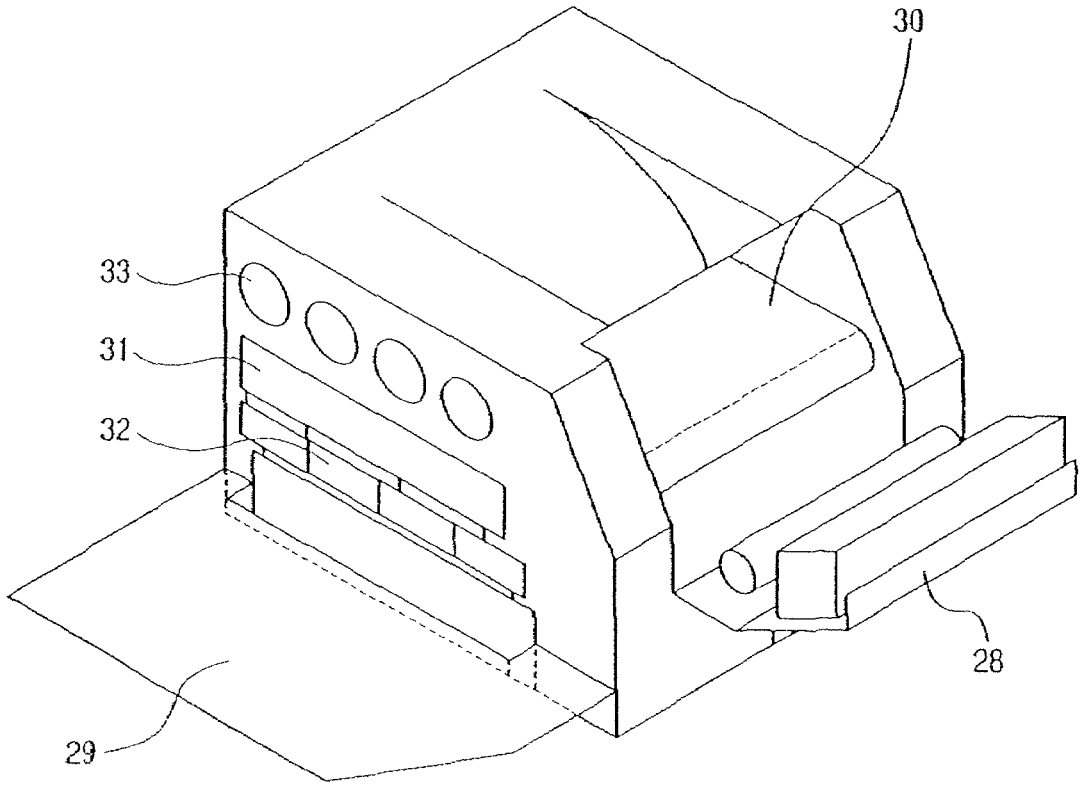
PRIOR ART FIG. 6
FIG. 6 is an explanatory view of a method of attaching and detaching respective components in the image forming apparatus in the conventional example.
Figure 7A:
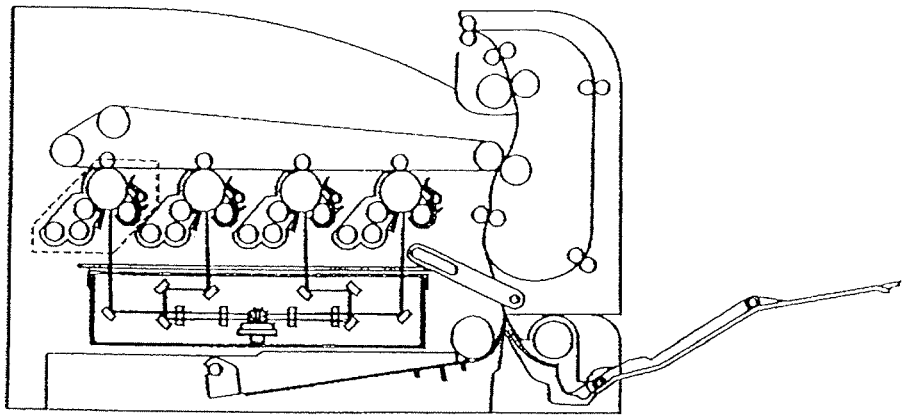
FIG. 7A PRIOR ART
FIGS. 7A and 7B are explanatory views of another image forming apparatus in the conventional example.
Figure 7B:
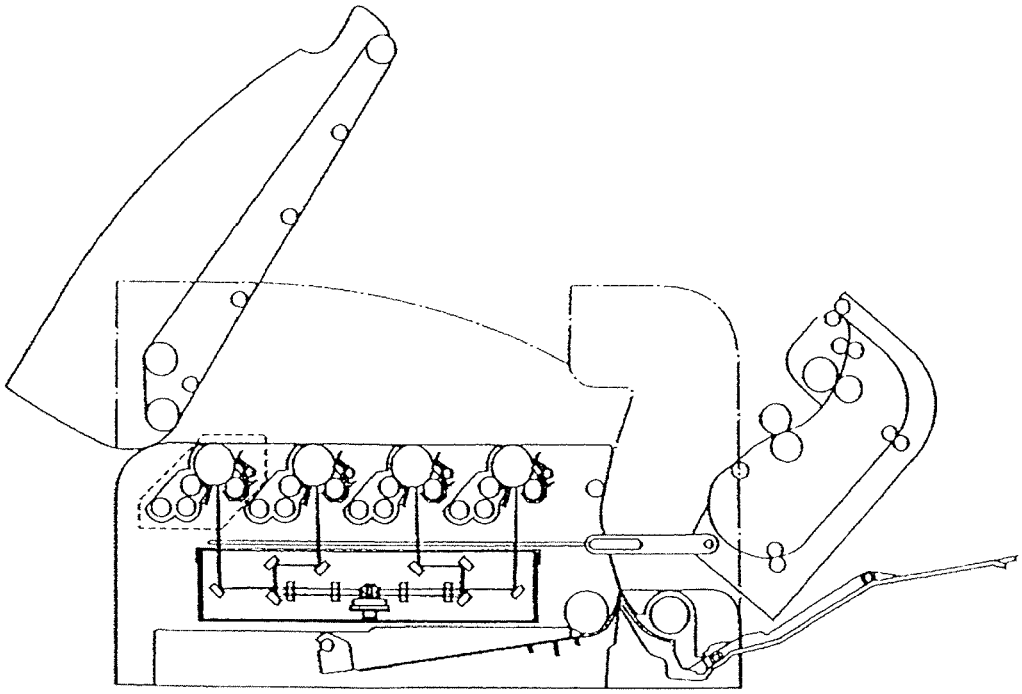
FIG. 7B PRIOR ART

FIG. 4 shows a detailed diagram of the vicinity of the secondary transfer portion of the image forming apparatus in a second embodiment of the present invention. The portions given the same explanations as those in the first embodiment are omitted. FIG. 4 is the diagram for explaining a relationship between the intermediate transferring belt 6, a process cartridge 10 and a secondary transfer portion 11. As described in the preceding first embodiment, the present invention has a scheme of improving the user's operability by providing the configuration that the process cartridges are detachably attached toward the front surface portion of the image forming apparatus, however, the second embodiment proposes a configuration for further downsizing the image forming apparatus and further improving the attachability/detachability of the process cartridge. As understood from FIG. 4, the image forming apparatus exemplified in the second embodiment has a configuration, wherein the process cartridge of the image forming portion closest to the secondary transfer portion takes a different trajectory when attached and detached. In the image forming apparatus including the plurality of image bearing members, the image forming portion close to the secondary transfer portion is set much closer to the secondary transfer portion, Whereby a depthwise size of the image forming apparatus can, it is obvious, be reduced. Then, in the second embodiment, when the process cartridge closest to the secondary transfer portion is pulled toward the front surface up to a position close to the secondary transfer portion, the angle of the attaching/detaching direction is changed, thus attaching and detaching the cartridge at an angle closer to the perpendicular direction. This configuration enables the process cartridge to be disposed in close proximity to the secondary transfer portion without contacting the secondary transfer portion when the process cartridge is attached and detached to the image forming apparatus. Herein, in the process cartridge close to the secondary transfer portion, the angle after the attaching/detaching angle has been changed may not depend on an angle area defined by the angle in the open state of the secondary transferring belt and by the angle in the open state of the front door. The reason why so is that the contact possibility is, due to being close to the secondary transfer portion, still low even when attached and detached in the perpendicular direction because of a large distance from the intermediate transferring belt with the rotational center being set on the back side. Furthermore, in the second embodiment, the process cartridges other than the process cartridge closest to the secondary transfer portion are constructed to be attached and detached at the same angle as in the first embodiment, and can be detachably attached in the forward direction without touching the transferring belt.

According to the present invention, the process cartridge can be easily attached and detached from the state where the user stands at the front surface portion of the image forming apparatus, and the user can perform the operations of attaching and detaching the process cartridge without touching the intermediate transferring belt with the user's hand. Moreover, none of the operation is conducted from the side surface portion of the image forming apparatus, and hence, without any necessity of preparing the space in the side surface portion of the image forming apparatus, it is possible to dispose the process cartridges in close proximity to the secondary transfer portion and to downsize the image forming apparatus as well as to improve the space efficiency of the apparatus.

Thus, according to the present invention, when taking the image forming unit out of an opening portion formed by rotating the intermediate transfer portion, it is feasible to prevent a damage to the intermediate transfer portion due to the takeout of the image forming unit close to the rotating portion.

In the embodiments given above, the process cartridge includes the image bearing member, the charging member and the developing means, however, the present invention is not limited to this construction, and the same effect as the present invention has can be acquired from a process cartridge constructed of the image bearing member and the charging member as one of other constructions.

The present invention has been described so far by way of the embodiments but is not absolutely limited to the embodiments given above and can be modified within the technical idea of the present invention.

This application claims priority from Japanese Patent Application No. 2004-329237 filed on Nov. 12, 2004, which is hereby incorporated by reference herein.

What is claimed is:

1. An image forming apparatus comprising:

a plurality of image forming units, each having an image bearing member and attachable to or detachable from a main body of the image forming apparatus;

an intermediate transferring member disposed above said plurality of image forming units and bearing toner images transferred from said image bearing members of said image forming units;

an open/close member having one end and another end, said open/close member supporting said intermediate transferring member and forming an opening portion to attach or detach said plurality of image forming units by pivoting the another end of said open/close member around a rotation axis provided at the one end of said open/close member;

a guide portion provided on the main body of the image forming apparatus, for guiding one of said plurality of image forming units when said one of said plurality of image forming units is attached to or detached from the main body of the image forming apparatus; and an inclined portion provided on said guide portion, said inclined portion being inclined so that an upstream portion in an insertion direction of said one of said plurality of image forming units is positioned at a side of the another end of said open/close member with regard to a downstream portion in the insertion direction of said one of said plurality of image forming units, wherein a position of said intermediate transferring member is fastened in a state in which said open/close member is opened when one of said plurality of image forming units is attached to the main body of the image forming apparatus, and an angle defined between said inclined portion and a horizontal direction is smaller than an angle defined between a direction along an externally appearing surface of said intermediate transferring member and the horizontal direction.

2. An image forming apparatus according to claim 1, wherein said one of plurality of image forming units is an image forming unit provided at a position that is closest to the one end of said open/close member among said plurality of image units forming attached onto the main body of the image forming apparatus.

3. An image forming apparatus comprising:

a plurality of image forming units, each having an image bearing member and attachable to or detachable from a main body of the image forming apparatus;

an intermediate transferring member disposed above said plurality of image forming units and bearing toner images transferred from said image bearing members of said image forming units;

an open/close member having one end and another end, said open/close member supporting said intermediate transferring member and forming an opening portion to attach or detach said plurality of image forming units by pivoting the another end of said open/close member around a rotation axis provided at the one end of said open/close member;

a guide portion provided on the main body of the image forming apparatus, for guiding one of said plurality of image forming units when said one of said plurality of image forming units is attached to or detached from the main body of the image forming apparatus;

an inclined portion provided on said guide portion, said inclined portion being inclined so that an up stream portion in an insertion direction of said one of said plurality of image forming units is positioned at a side of the another end of said open/close member with regard to a downstream portion in the insertion direction of said one of said plurality of image forming units, a recording material conveyance portion for conveying a recording material; and a second open/close member provided on a side surface of the main body of the image forming apparatus, wherein an angle defined between said inclined portion and a horizontal direction is larger than an angle between a surface direction of said second open/close member in open state in the case of attaching and detaching said image forming units and the horizontal direction.

4. An image forming apparatus according to claim 3, wherein said one of said plurality of image forming units is an image forming unit provided at a position that is closest to the one end of said open/close member among said plurality of image forming units attached onto the main body of the image forming apparatus.

5. An image forming apparatus comprising:

a plurality of image forming units, each having an image bearing member and attachable to or detachable from a main body of the image forming apparatus;

an intermediate transferring member disposed above said plurality of image forming units and bearing toner images transferred from said image bearing members of said image forming units;

an open/close member having one end and another end, said open/close member supporting said intermediate transferring member and forming an opening portion to attach or detach said plurality of image forming units by pivoting the another end of said open/close member around a rotation axis provided at the one end of said open/close member;

a guide portion provided on the main body of the image forming apparatus, for guiding one of said plurality of image forming units when said one of said plurality of image forming units is attached to or detached from the main body of the image forming apparatus; and an inclined portion provided on said guide portion, said inclined portion being inclined so that an upstream portion in an insertion direction of said one of said plurality of image forming units is positioned at a side of the another end of said open/close member with regard to a downstream portion in the insertion direction of said one of said plurality of image forming units, wherein said intermediate transferring member is rotatable together with a stack portion for stacking a recording material having an image formed therein.

* * * * *